US005802659A

United States Patent [19]

Chang

[11] Patent Number: 5,802,659

[45] Date of Patent: Sep. 8, 1998

[54] STRAPLIKE BATH SCRUBBER

[76] Inventor: Che-Yuan Chang, No. 1, Lane 147, Sec. 2, Chung Sanrd, Yunlin, Chang Hua Hsien, Taiwan

[21] Appl. No.: 819,995

[22] Filed: Mar. 18, 1997

[51] Int. Cl.[6] ..... A47K 7/02

[52] U.S. Cl. ..... 15/222; 15/209.1; 601/137

[58] Field of Search ..... 15/208, 209.1, 15/210.1, 222, 223, 229.11; 401/6, 8; 601/136–138

[56] References Cited

U.S. PATENT DOCUMENTS

| | | | |
|---|---|---|---|
| 5,295,280 | 3/1994 | Hudson et al. | 15/222 |
| 5,504,963 | 4/1996 | Bynum et al. | 15/222 |
| 5,555,591 | 9/1996 | Chang | 15/222 X |
| 5,560,071 | 10/1996 | Chang | 15/222 |

FOREIGN PATENT DOCUMENTS

| | | | |
|---|---|---|---|
| 1029241 | 1/1989 | Japan | 15/222 |

*Primary Examiner*—Mark Spisich
*Attorney, Agent, or Firm*—Browdy & Neimark

[57] ABSTRACT

A bath scrubber is composed of a main body, a plurality of first lashing members, and two fastening members. The main body is formed of a plurality of cylindrical netlike unit members. The first lashing members are disposed between two unit members. The fastening members are located at both ends of the main body. The unit members have a first portion and a second portion, which are connected by a second lashing member. The bath scrubber is somewhat flattened to increase its contact area with the skin of a bather.

7 Claims, 3 Drawing Sheets

10
12
14
16
20
22
24
25
26
27
28
3

STRAPLIKE BATH SCRUBBER

FIELD OF THE INVENTION

The present invention relates generally to a bath scrubber, and more particularly to a bath scrubbing strap.

BACKGROUND OF THE INVENTION

The inventor of the present invention is a holder of the U.S. Pat. No. 5,560,071, which discloses a straplike bath scrubber having an outer layer capable of bringing about an excellent scrubbing effect on a bather's skin. However, the straplike bath scrubber referred to above is limited in design in that its contact area with the skin is small, and that the bathing lotion carried by the bath scrubber is incapable of foaming effectively to cleanse the skin.

SUMMARY OF THE INVENTION

The primary objective of the present invention is to overcome the drawbacks of the prior art bath scrubber described above.

In keeping with the principle of the present invention, the foregoing objective of the present invention is attained by an improved bath scrubber, which comprises a main body, a plurality of first lashing members, and two fastening members. The main body is formed of a plurality of elastic netlike units which are arranged along a predetermined axial direction. The first lashing members are arranged between two adjoining netlike units. The fastening members are located at both ends of the main body. Each netlike unit has a first portion and a second portion, which are connected by a second lashing member such that each netlike unit is slightly flat to afford a greater contact area between the bath scrubber and the skin of a person using the bath scrubber.

The foregoing objective, features, functions, and advantages of the present invention will be more readily understood upon a thoughtful deliberation of the following detailed description of the embodiments of the present invention in conjunction with the accompanying drawings.

DETAILED DESCRIPTION OF THE INVENTION

Figures 1, 2, 3:
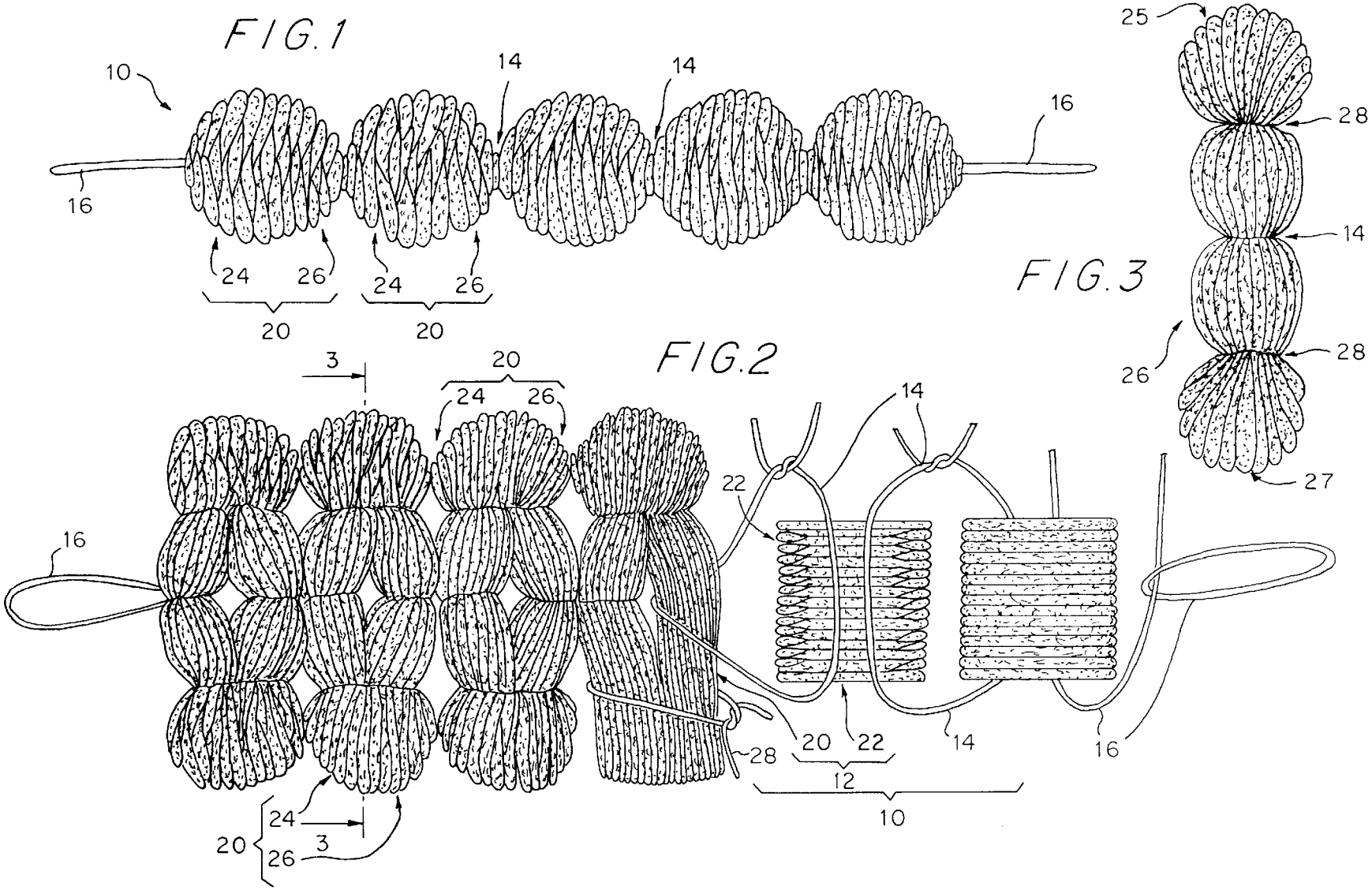
FIG. 1 shows a top view of a first preferred embodiment of the present invention.
FIG. 2 shows an exploded view taken along the direction of the front view of the first preferred embodiment of the present invention.
FIG. 3 shows a sectional view taken along the direction indicated by a line 3—3 as shown in FIG. 2.

As shown in FIGS. 1 and 2, a straplike bath scrubber 10 embodied in the present invention is composed of a main body 12, a plurality of first lashing members 14, two fastening members 16, and a plurality of second lashing members 28.

The main body 12 is formed of a plurality of unit members 20 which are connected in a parallel manner. Each unit member 20 is an elastic cylindrical net 22 having a periphery which is corrugated along the direction of the longitudinal axis of the cylindrical net 22.

Each of the first lashing members 14 is in fact a string of an appropriate strength and is used to fasten securely the corresponding sides of the two cylindrical nets 22 such that the fringes of the cylindrical nets 22 are corrugated, and that the cylindrical nets 22 can be expanded to be spherical along two corresponding first lashing members 14 serving as an axis.

The fastening members 16 are elastic strings longer than the first lashing member 14 and are fastened with the outer sides of the two cylindrical nets 22 which are located at both ends of the main body 12, thereby enabling the cylindrical nets 22 to expand to become spherical in shape along the fastening members 16 serving as an axis. In addition, the fastening members 16 may be used as a means for holding the bath scrubber 10.

The bath scrubber 10 of the present invention is characterized in design in that each unit member 20 (the cylindrical net 22) has a first portion 24 and a second portion 26, which are arranged along the direction of the longitudinal axis of the main body 12, and that each of the first lashing members 14 is connected with the midsections of the first portion 24 and the second portion 26, as shown in FIG. 3, and further that the first portion 24 and the second portion 26 of each unit member 20 are fastened respectively with two second lashing members 28, which are separated at an interval from a front end 25 and a rear end 27 of a body formed jointly by the first portion 24 and the second portion 26. As a result, the spherical unit member 20 is somewhat flattened to enhance its cleansing effect. In addition, the wavy outer layer of the unit member 20 is made erratic to enhance the cleansing action of the unit member 20.

Two adjoining unit members 20 may be fastened by the first lashing member 14 such that the two unit members 20 are fastened together, or that the two unit members 20 are separated from each other by an interval so as to enable both ends of the first lashing member 14 to become connected with the two unit members 20.

Figure 4:
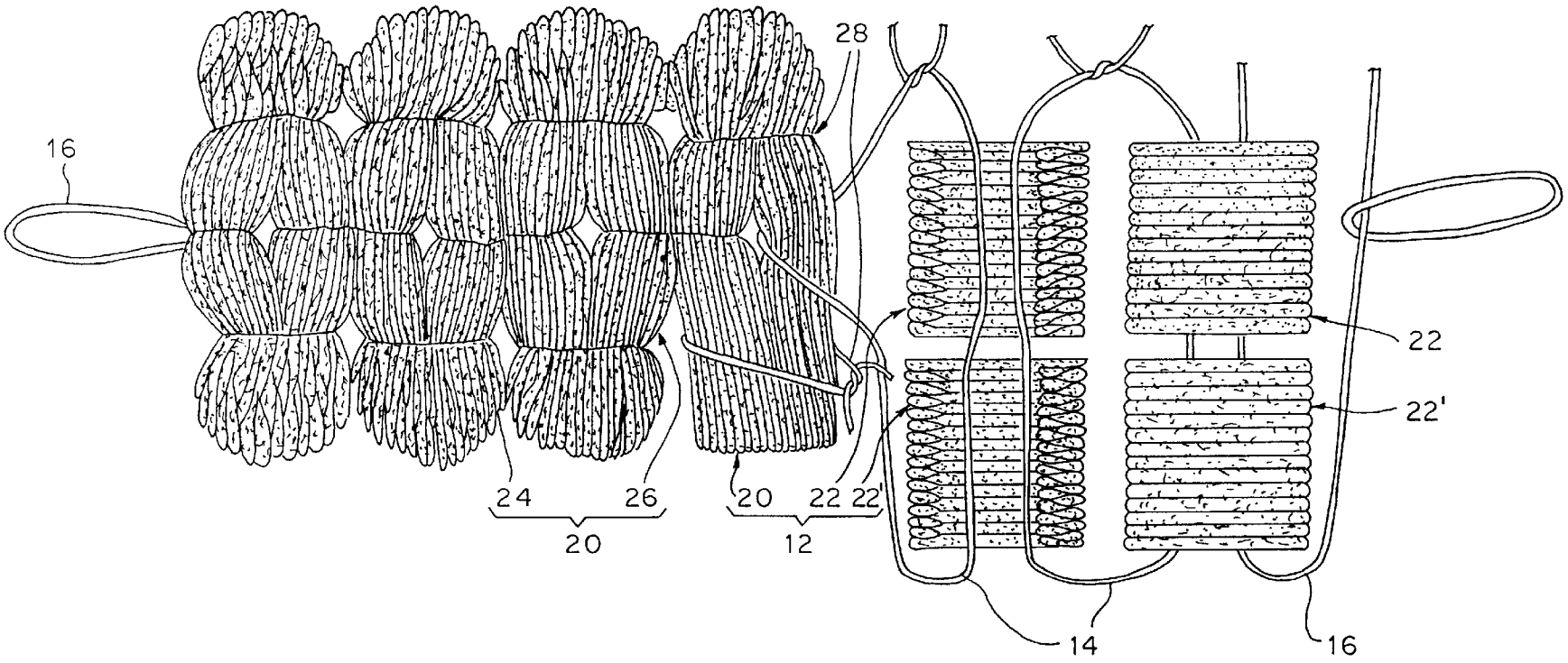
FIG. 4 shows an exploded view of a second preferred embodiment of the present invention.

As illustrated in FIG. 4, a bath scrubber 10 of the second preferred embodiment of the present invention is formed of a plurality of unit members 20, which are composed of a plurality of cylindrical nets 22 and 22' that are connected in series. In addition, the cylindrical nets 22 and 22', and the two adjoining unit members 20 are fastened by the second lashing member 14. As a result, the cylindrical nets 22 of different colors may be used to make the unit member 20 or the straplike bath scrubber 10.

Figure 5:
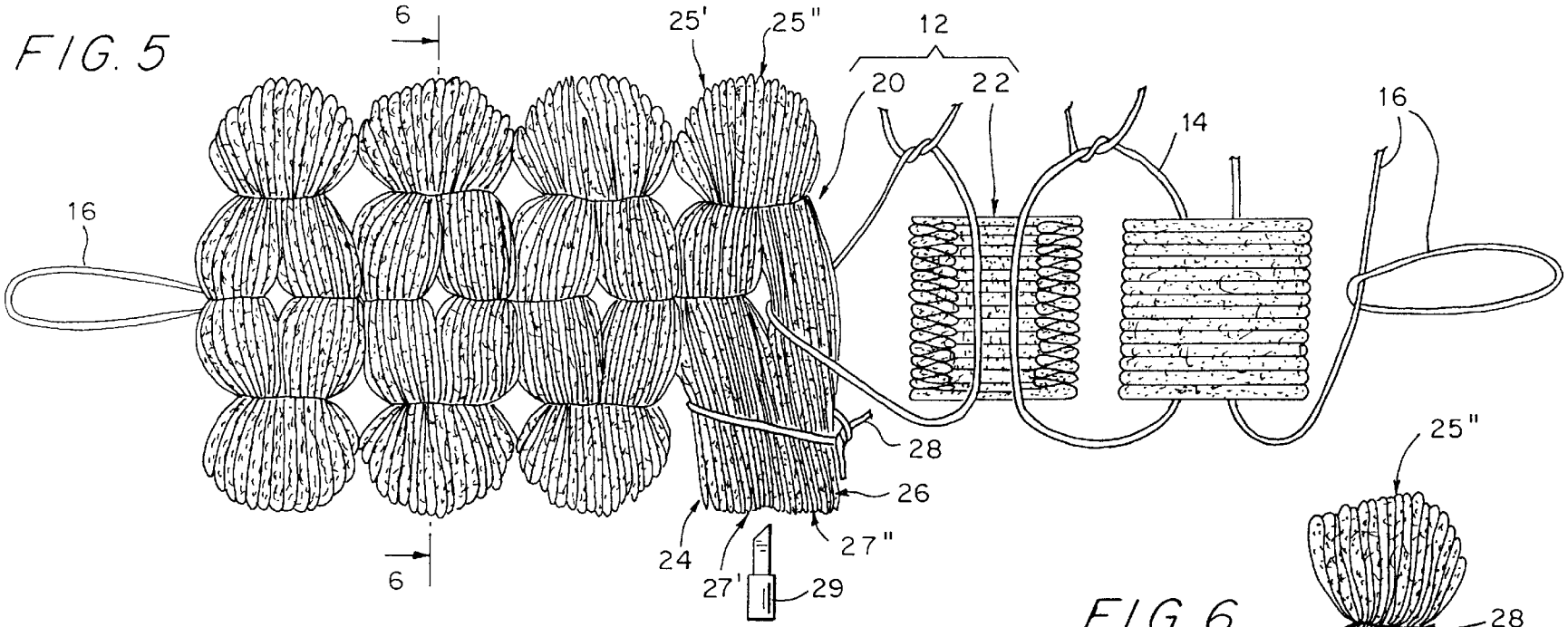
FIG. 5 shows an exploded view of a third preferred embodiment of the present invention.
Figure 6:
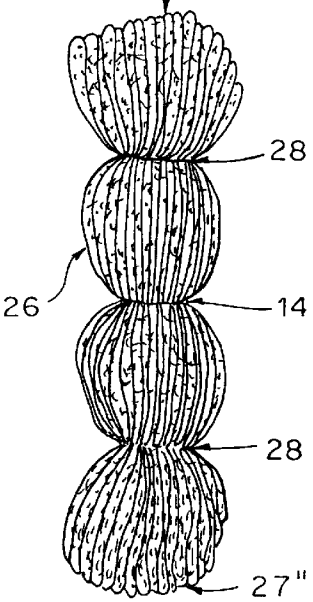
FIG. 6 shows a sectional view taken along the direction indicated by a line 6—6 as shown in FIG. 5.

As illustrated in FIGS. 5 and 6, the bath scrubber 10 of the third preferred embodiment of the present invention is characterized in design in that the unit members 20 have the first portion 24 and the second portion 26, which are independent of each other. In addition, the front ends 25' and 27', and the rear ends 25" and 27" are not connected. Both ends of the unit member 20 can be expanded along the second lashing member 28 serving as an axis. The tail ends of the front ends 25', 25" and the rear ends 27', 27" are not connected, thereby enabling the unit member 20 to be expanded to a greater extent.

The first portion 24 and the second portion 26 may be made of independent platelike nets or a plurality of cylindrical nets 22 which are used to form the main body 12. The front end 25 and the rear end 27 of the cylindrical net 22 (unit member 20) are severed by a cutter 29 so as to attain the independent first and second portions 24 and 26.

What is claimed is:

1. A bath scrubber comprising:

a main body formed of a plurality of netlike unit members connected along a predetermined axial direction;

a plurality of first lashing members located respectively between pairs of adjacent unit members; and two fastening members fastened at respective opposite ends of said main body;

wherein said unit members each have a first portion and a second portion, which are arranged along the direction of a longitudinal axis of said main body and wherein the ends of said first portion and said second portion are connected by a second lashing member.

2. The bath scrubber as defined in claim 1, wherein said unit members are elastic cylindrical nets having a wavy periphery.

3. The bath scrubber as defined in claim 1, wherein said unit members are composed of at least two cylindrical nets arranged in series.

4. The bath scrubber as defined in claim 1, wherein two of said unit members are connected by said first lashing member such that fringes of said unit members are in intimate contact with one another.

5. The both scrubber as defined in claim 1, wherein said unit members are separated from one another at an interval such that said unit members are connected with both ends of said first lashing members corresponding to said unit members.

6. The bath scrubber as defined in claim 1, wherein both ends of said first portion and said second portion of said unit members are connected integrally such that said both ends are separated from said second lashing members.

7. The bath scrubber as defined in claim 1, wherein said first portion and said second portion of said unit members are independent of each other; and wherein said second lashing members are separated from ends of said first portion and said second portion.

* * * * *